US006053195A

United States Patent [19]

Heer

[11] Patent Number: 6,053,195

[45] Date of Patent: Apr. 25, 2000

[54] PRESSURE CONTROL VALVE

[75] Inventor: Siegfried Heer, Kirchdorf/Krems, Austria

[73] Assignee: TCG Unitech Aktiengesellschaft, Kirchdorf/Krems, Australia

[21] Appl. No.: 09/173,657

[22] Filed: Oct. 16, 1998

[30] Foreign Application Priority Data

Oct. 16, 1997 [AT] Austria ..... 1759/97

[51] Int. Cl.[7] ..... F16K 31/363

[52] U.S. Cl. ..... 137/115.21; 137/87.06

[58] Field of Search ..... 137/115.21, 87.06, 137/495

[56] References Cited

U.S. PATENT DOCUMENTS

| | | | |
|---|---|---|---|
| 2,767,726 | 10/1956 | Feucht | 137/115.21 |
| 4,062,374 | 12/1977 | Marshall et al. | 137/115.21 |
| 4,139,015 | 2/1979 | Sakai | 137/115.21 |

FOREIGN PATENT DOCUMENTS 969922 5/1978 U.S.S.R. .

*Primary Examiner*—Stephen M. Hepperle

*Attorney, Agent, or Firm*—Watson Cole Grindle Watson, P.L.L.C.

[57] ABSTRACT

The present invention relates to a pressure control valve for regulating the oil pressure in an oil supply system preferably of an internal combustion engine, with a first working chamber which is in connection with an oil line, with a second working chamber which is in connection with an oil supply line, and with a control slide valve which is substantially movable by the oil pressure in the first working chamber in order to release a throttling aperture on exceeding a first predetermined oil pressure through which oil is released from the second working chamber to a recirculation system. A constructional simplification is achieved in such a way that the control slide valve is provided with a control element which is movable by the oil pressure in the second working chamber relative to a main body of the control slide valve and which on exceeding a second predetermined oil pressure in the second working chamber will release the throttling opening through which oil from the second working chamber is released to the recirculation system.

10 Claims, 1 Drawing Sheet

PRESSURE CONTROL VALVE

FIELD OF THE INVENTION

The present invention relates to a pressure control valve for regulating the oil pressure in an oil supply system, preferably of an internal combustion engine, with a first working chamber which is in connection with an oil line, with a second working chamber which is in connection with an oil supply line, and with a control slide valve which is substantially movable by the oil pressure in the first working chamber, with the control slide valve releasing the throttling aperture when exceeding a first predetermined oil pressure in the first working chamber through which the oil from the second working chamber is released into a recirculation system, and with the control slide valve having a control element formed as a piston which is movable in the axial direction by the oil pressure in the second working chamber relative to a main body of the control slide valve and which on exceeding a second predetermined oil pressure in the second working chamber releases the throttling aperture through which oil from the second working chamber is released into the recirculation system.

PRIOR ART

In the oil supply systems of machines such as the lubricating oil system of an internal combustion engine it is necessary to maintain a certain system pressure. As the oil pump of such an internal combustion engine is generally directly driven by the internal combustion engine per se, the conveying output of the oil supply pump is strongly dependent on the rotational speed of the internal combustion engine. Although the oil consumption also depends on the speed, these dependencies are not completely synchronous, so that it is necessary to design the oil pump for the most unfavourable case in order to be able to permanently maintain the minimally required oil pressure. In other operational states, however, the conveyed oil quantity of the oil supply pump will exceed the actual demand, so that the oil pressure would increase excessively. In order to prevent this, pressure control valves are generally provided for in such oil supply systems.

A known pressure control valve is arranged in such a way that a cylinder chamber is in connection with the main oil duct of the machine, with the oil pressure in the main oil duct moving a control slide valve against the action of a spring. A working chamber in this pressure control valve is in connection with an oil supply line and comprises a throttling edge which is controlled by the control slide valve. If the pressure in the main oil duct exceeds a predetermined value, a control edge of the control slide valve reaches a throttling aperture, so that the oil from the supply line is released into a recirculation system. The release is made for such a time until the pressure in the main oil duct has dropped to such an extent that the spring in the pressure control valve returns the slide valve to such an extent that the throttling aperture is closed again. This allows producing a nearly constant oil pressure in the main oil duct. However, there are operational states such as cold starting at extremely low temperatures where the aforementioned control system is inadequate. If the flow resistances are very high owing to extremely low temperatures, then it is possible that excessively high pressure peaks occur immediately downstream of the oil pump, although at the location of the main oil duct at which the oil pressure for the pressure control valve is tapped the pressure is still not so high so as to open the pressure control valve. For this reason a pressure relief valve is usually additionally provided in the oil supply line in order to enable the prevention of a pressure peak even at extreme operating states which can lead to damage in the machine.

Moreover, from SU-A 969 922 a pressure control valve is known in which a piston is arranged in a slide valve. As a result of a movement of the slide valve a first control edge is released, whereas an other control valve is released by a movement of the piston. The production of such a valve with the desired precision is complex, particularly with respect to the two control edges.

SUMMARY OF THE INVENTION

It is the object of the present invention to simply the system as described above and to particularly provide a pressure control valve which allows a secure and reliable oil pressure regulation in all operational states without requiring additional components. Special attention is to be given to the capability for easy and precise manufacturing.

DISCLOSURE OF INVENTION

This is achieved in accordance with the invention in such a way that the main body is provided with a guide rod on which the piston is displaceably held in the axial direction and that the control slide valve will release the throttling aperture over the same control edge both when exceeding the first predetermined oil pressure in the first working chamber as well as when exceeding the second predetermined oil pressure in the second working chamber.

The relevant aspect of the present invention is that the pressure control valve additionally assumes the function of a pressure relief valve, and makes the same superfluous, without requiring any additional constructional space, and all this with a minimal additional constructional effort as compared with a known pressure control valve. In particular, no additional line connections or the like are required by the present invention.

A particularly simple constructional realization of the pressure control valve in accordance with the invention is given in such a way that preferably the main body of the control slide valve is provided with a collar which separates the first working chamber from the second one. It is particularly favourable if the control element is arranged as a piston which is movable on a guide rod of the main body in the axial direction with respect to the main body of the control slide valve.

It is provided in a preferred embodiment of the present invention that the main body is provided with a stop which entrains the piston in the direction of the opening of the throttling aperture. During the normal function as pressure control valve the piston permanently rests on the stop. Merely in the presence of extreme operational states that would require a response of the pressure relief valve will the piston lift off from the stop in order to thus provide a function of pressure relief.

Different embodiments of the invention are principally possible. In a preferred embodiment of the invention a first spring is arranged between the piston and a supporting area fixed with the valve, whereas a second spring is arranged between the main body and the piston. The first spring is used for resetting the control slide valve in normal operation as pressure control valve. The second spring presses the piston against the stop. When the pressure in the second working chamber exceeds a value which exerts such a force on the piston which is higher than the sum total of the pretensioning forces of the first and second spring, the piston will lift off from the stop and release the throttling opening. Preferably, the first and second spring are arranged coaxially within one another. This leads to a particuarly compact arrangement of the valve in accordance with the invention.

As an alternative to aforementioned embodiment it is also possible to arrange the first and second spring above one another, so that the first spring pretensions the main body upwardly, whereas the second spring results in a pretensioning force between main body and piston. In this embodiment the pressure relief function of the valve will be initiated when the pressure in the second working chamber exceeds the pretensioning force of the second spring alone.

A further simplification of the structure of the pressure control valve in accordance with the invention is obtained in that the collar and the piston are arranged in a movable way in the axial direction in a common bore.

BRIEF DESCRIPTION OF THE DRAWINGS

The present invention is now explained in closer detail by reference to the embodiments shown in the figures, wherein.

DETAILED DESCRIPTION OF THE PREFERRED EMBODIMENTS

Figure 3:
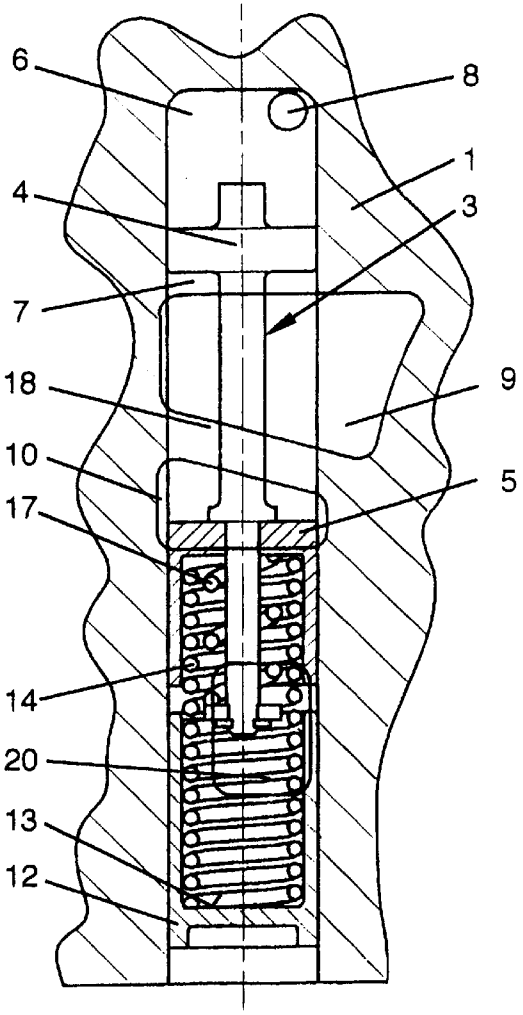
FIG. 1 shows a longitudinal sectional view through a pressure control valve in accordance with the invention in a first working position and FIGS. 2 and 3 show further working positions of the pressure control valve of FIG. 1.

The pressure control valve consists of a housing 1 in which a cylindrical bore 2 is provided. A control slide valve 3 consists of a main body 4 and a piston 5. A collar 19 of the main body 4 separates a first working chamber 6 from a second working chamber 7. The first working chamber 6 is in connection via a connection 8 with a main oil duct (not shown in closer detail) of an internal combustion engine (also not shown in closer detail). The pressure in working chamber 6 exercises a downwardly directed force onto control slide valve 3 which is proportional to the pressure in the main oil duct.

The second working chamber 7 is in connection with an oil supply line via a schematically shown recess 9 through which the internal combustion engine is supplied by an oil pump with lubricating oil. These components are also not shown. A throttling aperture 10 is provided below the opening 9, which aperture is controlled by a control edge 11 of the piston 5. The throttling aperture 10 is in connection with an oil supply recirculation system.

A sealing element 12 which is screwed into the cylinder comprises a bearing surface 13 on which a first spring 14 rests. The first spring 14 further rests on the lower side of the piston 5 in order to pretension the same upwardly. A Seeger circlip ring 15 is further attached at the lower end of the main body 4 of the control slide valve 5, which ring carries a supporting ring 16. A second spring 17 rests on the supporting ring 16, which spring also pretensions the piston 5 upwardly.

The mode of operation of the pressure control valve in accordance with the invention will be explained below.

Figure 1:
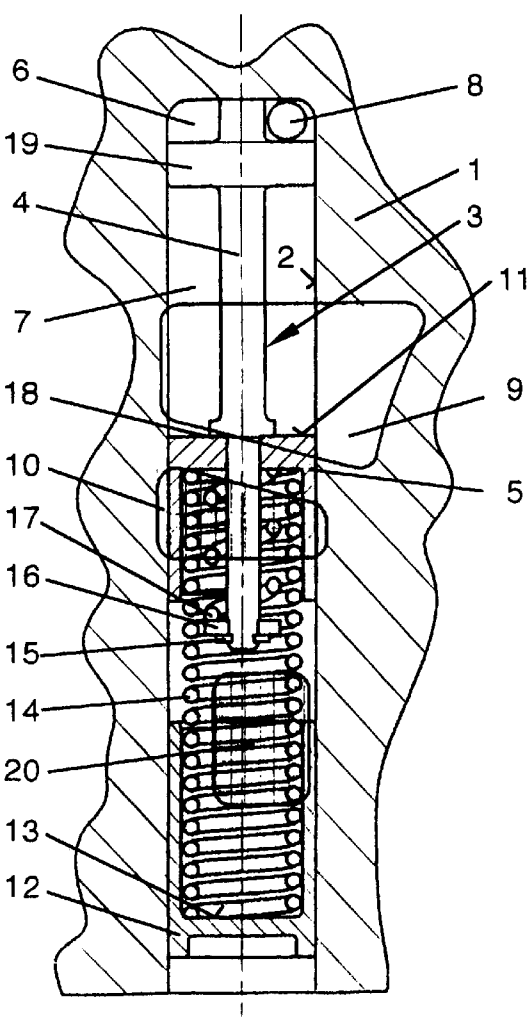

FIG. 1 shows a state in which the pressure of the main oil duct is below a predetermined setpoint value. The pressure in the oil supply line is also below a predetermined maximum value which is higher than the setpoint value in the main oil duct. Therefore the pressure in the first working chamber 6 is insufficient to press the slide valve 3 downwardly against the resistance of the first spring 14. In the same way, the pressure in the second working chamber 7 is insufficient to lift off the piston 5 from the stop 18. For these reasons the piston 5 is disposed in its upper end position in which the throttling aperture 10 is closed.

Figure 2:
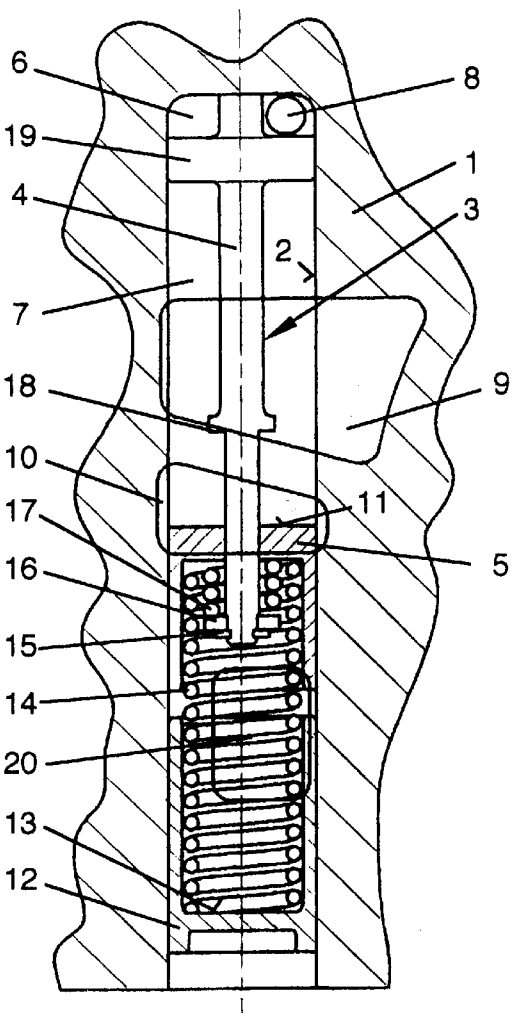

FIG. 2 shows a case which corresponds to a cold start at extremely low temperatures. The pressure in the oil supply line is very high, but as a result of the flow resistances the pressure in the main oil duct has not risen to the extent so as to downwardly move the slide valve 3 of the pressure control valve. In order to avoid damage to the internal combustion engine as a result of excessive oil pressure in the oil supply line, it is necessary to perform a pressure relief in this state. The high pressure in the second working chamber 7 causes the piston 5 to lift off from stop 18 against the pretensioning forces of the first and second spring 14 and 17 in order to slide downwardly on the main body 4 of the control slide valve 3. As a result, the control edge 11 of the piston 5 releases the throttling aperture 10, as a result of which oil is released from the oil supply line to the recirculation system. Only when the oil pressure in the second working chamber 7 has fallen below the maximum permitted value will piston 5 be allowed to move upwardly again by the force of the spring. Damage to the internal combustion engine by excessive oil pressure can thus securely be prevented.

FIG. 3 shows a state in which the pressure in the main oil duct has reached or exceed a predetermined setpoint value, whereas the pressure in the oil supply line moves within the permitted range. The oil pressure in the first working chamber 6 multiplied with the cross-sectional area of the collar 19 of the control slide valve 3 leads to a force which exceeds the pretensioning force of the first spring 14. In this way the control slide valve 3 is moved downwardly to such an extent that the control surface 11 of the piston 5 releases the throttling aperture 10. In this way oil is released from the oil supply line via the throttling aperture 10 for such a time until the pressure in the main oil duct has reached the setpoint value or falls below the same.

A ventilation opening 20 is used for ventilating the space below the piston 5 in which springs 14 and 17 are arranged.

The present invention substantially corresponds in a constructional respect to a known pressure control valve. The only difference is that the piston 5 is movably arranged relative to the main body 4 of the control slide valve 3 and that the second spring 17 is provided for pretensioning the piston 5 against the main body 4 of the control slide valve 3. In this way it is possible to use the housing 1 with the opening 9 and the throttling aperture 10 without any changes from a known pressure control valve. Merely the control slide valve 3 must be arranged in accordance with the invention. In this way it is possible to achieve an additional function with minimal effort which allows omitting an other component, namely a separate pressure relief valve. The particularly advantageous aspect is that the additional function does not cause any increase in installed size and thus no additional weight.

I claim:

1. A pressure control valve for regulating the oil pressure in an oil supply system, with a first working chamber which is in connection with an oil line, with a second working chamber which is in connection with an oil supply line, and with a control slide valve which is substantially movable by the oil pressure in the first working chamber, with the control slide valve releasing the throttling aperture when exceeding a first predetermined oil pressure in the first working chamber, through which the oil from the second working chamber is released into a recirculation system, and with the control slide valve having a control element arranged as a piston which is movable in the axial direction by the oil pressure in the second working chamber relative to a main body of the control slide valve and which on exceeding a second predetermined oil pressure in the second working chamber releases the throttling aperture through which oil from the second working chamber is released into the recirculation system, characterized in that the main body is provided with a guide rod on which the piston is displaceably held in the axial direction and that the control slide valve will release the throttling aperture via the same control edge both when exceeding the first predetermined oil pressure in the first working chamber as well as when exceeding the second predetermined oil pressure in the second working chamber.

2. A pressure control valve according to claim 1, wherein the main body of the control slide valve is provided with a collar which separates the first working chamber from the second working chamber.

3. A pressure control valve according to claim 1, wherein the control element is arranged as a piston which is movable in the axial direction relative to the main body of the control slide valve on a guide rod of the main body.

4. A pressure control valve according to claim 3, wherein the piston comprises a control edge which co-operates with the throttling aperture.

5. A pressure control valve according to claim 3, wherein the main body is provided with a stop which entrains the piston in the direction of the opening of the throttling aperture.

6. A pressure control valve according to claim 3, wherein a first spring is provided between the piston and a supporting surface fixed with the valve, which spring biases the piston in a direction opposite of the direction of the opening of the throttling aperture.

7. A pressure control valve according to claim 3, wherein a first spring is provided between the main body of the control slide valve and a supporting surface fixed with the valve, which spring biases the piston in a direction opposite of the direction of the opening of the throttling aperture.

8. A pressure control valve according to claim 3, wherein a second spring is provided between the main body of the control slide valve and the piston.

9. A pressure control valve according to claim 8, wherein the first and the second spring are arranged coaxially with respect to one another.

10. A pressure control valve according to claim 3, wherein the collar and the piston are movably arranged in the axial direction in a common bore.

* * * * *

UNITED STATES PATENT AND TRADEMARK OFFICE

CERTIFICATE OF CORRECTION

PATENT NO. : 6,053,195
DATED : April 25, 2000
INVENTOR(S) : Siegfried Heer

It is certified that error appears in the above-identified patent and that said Letters Patent is hereby corrected as shown below:

Title page,
Item [73], should read as follows:

[73] Assignee: TCG UNITECH AKTIENGESELLSCHAFT
KIRCHDORF/KREMS, AUSTRIA

Signed and Sealed this

Thirteenth Day of November, 2001

*Attest:*

Nicholas P. Godici

NICHOLAS P. GODICI
*Acting Director of the United States Patent and Trademark Office*

*Attesting Officer*